US007478964B2

(12) United States Patent
Hoogland

(10) Patent No.: US 7,478,964 B2
(45) Date of Patent: Jan. 20, 2009

(54) FILE, IN PARTICULAR ARCHIVE OR TRAVEL FILE

(75) Inventor: Hendricus Antonius Hoogland, Krommenie (NL)

(73) Assignee: Fountain Technologies B.V., LC Capelle A/D Ijssel (NL)

( * ) Notice: Subject to any disclaimer, the term of this patent is extended or adjusted under 35 U.S.C. 154(b) by 418 days.

(21) Appl. No.: 10/507,401

(22) PCT Filed: Mar. 12, 2003

(86) PCT No.: PCT/NL03/00187

§ 371 (c)(1),
(2), (4) Date: Apr. 18, 2005

(87) PCT Pub. No.: WO03/076207

PCT Pub. Date: Sep. 18, 2003

(65) Prior Publication Data

US 2005/0271460 A1 Dec. 8, 2005

(30) Foreign Application Priority Data

Mar. 12, 2002 (NL) ..... 1020158
Jan. 24, 2003 (NL) ..... 1022485

(51) Int. Cl.

| | |
|---|---|
| ***B42D 1/00*** | (2006.01) |
| ***B42D 5/00*** | (2006.01) |
| ***B42D 3/00*** | (2006.01) |
| ***B42F 13/00*** | (2006.01) |
| ***B42F 13/12*** | (2006.01) |
| ***B42F 13/40*** | (2006.01) |

(52) U.S. Cl. ..... 402/73; 402/80 R; 402/502; 281/20; 281/28; 281/29; 281/45

(58) Field of Classification Search ..... 402/73, 402/80 R, 502; 281/20, 28, 29, 45
See application file for complete search history.

(56) References Cited

U.S. PATENT DOCUMENTS

| | | | | |
|---|---|---|---|---|
| 1,726,684 | A * | 9/1929 | Sollom | 281/20 |
| 4,294,558 | A * | 10/1981 | Errichiello | 402/75 |
| 4,569,613 | A * | 2/1986 | Thomas | 402/80 R |

(Continued)

FOREIGN PATENT DOCUMENTS

| | | |
|---|---|---|
| DE | 1 611 035 | 8/1970 |
| DE | 25 05 654 | 8/1976 |
| DE | 90 15 136.4 | 1/1991 |

*Primary Examiner*—Derris H Banks
*Assistant Examiner*—Kyle Grabowski
(74) *Attorney, Agent, or Firm*—Hoffmann & Baron, LLP

(57) ABSTRACT

A file (100), provided with a front cover (2), a back cover (3) and a spine (4) connecting the covers, wherein a binding element is provided for detachably fixing sheets, between the front (2) and back cover (3), wherein at least the front cover (2) and the back cover (3) are provide with a longitudinal edge and wherein a closure element is provided, which can be coupled to at least one longitudinal edge, such that the space enclosed by the front cover (2), back cover (3) and the spine (4) is covered by the closure element and the file (100) with the closure element has a substantially closed box shape.

12 Claims, 12 Drawing Sheets

U.S. PATENT DOCUMENTS 4,682,792 A * 7/1987 Simmons ..... 281/45
4,793,633 A * 12/1988 Rose, Jr. ..... 281/45
4,997,207 A * 3/1991 Feldman ..... 281/18
5,069,567 A 12/1991 Fink et al.
5,213,433 A * 5/1993 An ..... 402/14
5,897,141 A * 4/1999 Dugmore et al. ..... 281/20

* cited by examiner

FILE, IN PARTICULAR ARCHIVE OR TRAVEL FILE

This application is the U.S. National Phase of International Application Number PCT/NL03/00187 filed on 12 Mar. 2003, which is incorporated herein by reference.

BACKGROUND OF THE INVENTION

The invention relates to a file, comprising a front cover, a back cover, a spine connecting the covers and a binding mechanism for detachably binding sheets in the file.

To store, for instance, paper, frequent use is made of files, for instance manufactured from cardboard, plastic and combinations thereof, wherein a front cover and a back cover are hingedly connected with a spine and wherein a binding mechanism is fixed on the back cover. The binding mechanism can be opened to fix perforated sheets thereon and can be closed to secure these sheets.

For filing, the contents of a file are usually taken out and bound with a separate binding means, after which the bound contents are secured in a box file and filed away. This protects the filed contents against pollution, while the contents, for instance date, subjects and the like, can be simply indicated on the box file. Such a use of files has the disadvantage that taking out the contents, re-binding them and filing them in box files is time-consuming and expensive, as are the box files to be used themselves. In addition, the contents then become less easily accessible. Placing the files directly in a filing department has the disadvantage that the contents remain approachable from the surroundings, so that pollution can easily occur, for instance dust and the like, while, in addition, there is a chance that parts of the contents unintentionally come loose from the file and are lost.

SUMMARY OF THE INVENTION

The invention has for its object to provide a file of the type described in the opening paragraph, in which the above disadvantages are avoided, while retaining the advantages thereof. To this end, a file according to the invention is characterized by the features of claim 1.

In a file according to the present invention, a closure element is provided that can be fixed on the edges of at least the covers, or is fixedly connected thereto, such that, when, for instance, a file is full, at least ready for filing, the closure element can be positioned such that a substantially closed, box-shaped outer form is obtained, since the closure element closes off the normally open sides of the file. In this manner, the file can be filed in a filing department all at once, together with the contents, wherein the contents are simply and suitably protected against pollution, getting lost and the like, while the normal function of the file is preserved and the contents are optimally accessible.

A closure element for a file according to the invention can be manufactured separately and be embodied such that this can be fixed on the longitudinal edges of both covers and optionally the spine with suitable coupling elements, for instance clamping means or the like. In an alternative embodiment, the closure element is at least partly pivotally connected to at least one of the covers and/or the spine, for instance by suitable, co-formed hinge means, such that, during normal use of the file, the closure element, at least parts thereof is, at least are pivoted against one or both covers and, prior to filing, can be pivoted to a closing position wherein the side of the respective parts remote from the respective hinge means is fixed on a longitudinal edge of an opposite cover. Such an embodiment has the advantage that no loose parts are needed.

In a further advantageous embodiment, the closure element is embodied such that the closure elements of a series of files according to the invention can be intercoupled, such that a row of interconnected files is obtained from which files can be taken away individually, leaving the corresponding closure element behind in the row. In this way, a stable row of files can be obtained in a particularly simple manner without external support means.

Usually, files are provided with an opening in the spine through which a finger can be inserted in order to simply pull a file from a row. A file according to the invention can also be provided with such an opening, wherein preferably a sealing cap is provided for placing in said opening when the file is put away for filing. Such a sealing cap provides a further protection of the contents of the file, while it can be used, for instance by means of coding, to simply indicate information on the contents. For this purpose, for instance, numbers and/or letter combinations can be used, or shape or color-coding.

The invention further relates to a closure element, evidently suitable and intended for use with or in a file according to the present invention.

BRIEF DESCRIPTION OF THE DRAWINGS

In clarification of the invention, exemplary embodiments of a file with closure element according to the invention will be explained in more detail with reference to the drawing. In this drawing.

DETAILED DESCRIPTION OF THE INVENTION

Figure 1:
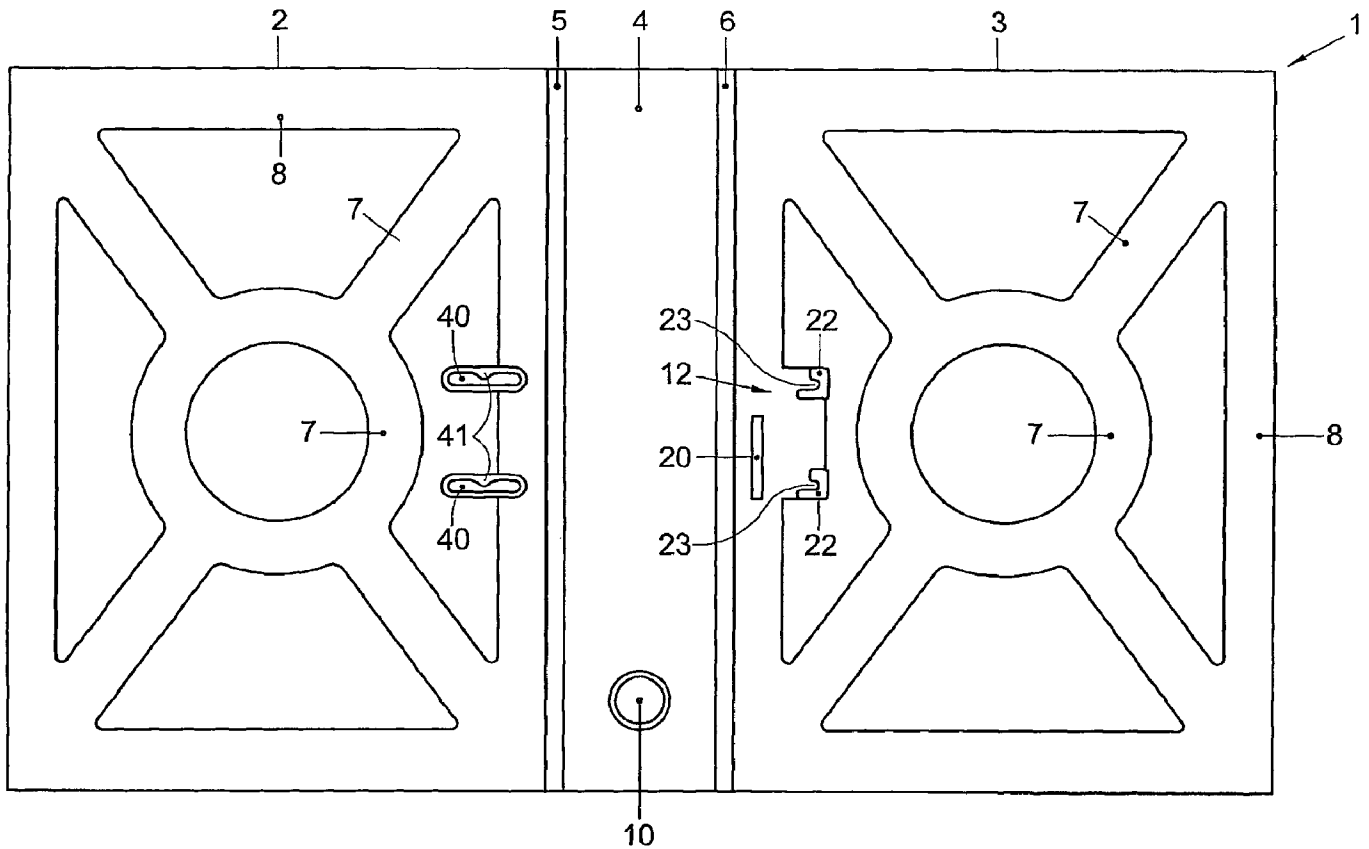
FIG. 1 shows a cover of a file according to the invention, in open condition, seen from the inside.
Figure 2:
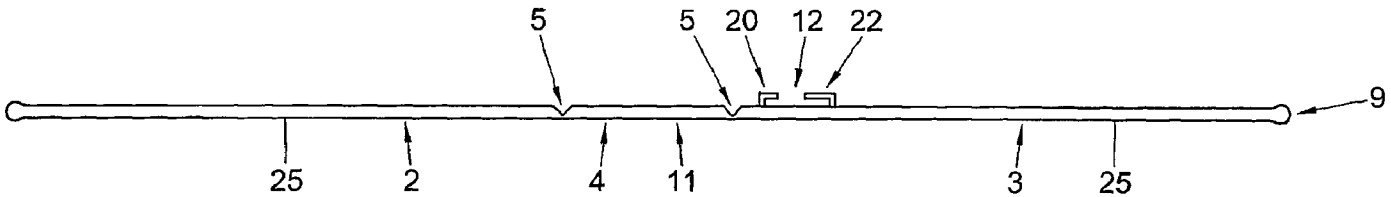
FIG. 2 shows, in side view and in open condition, the cover according to FIG. 1.
Figure 8:
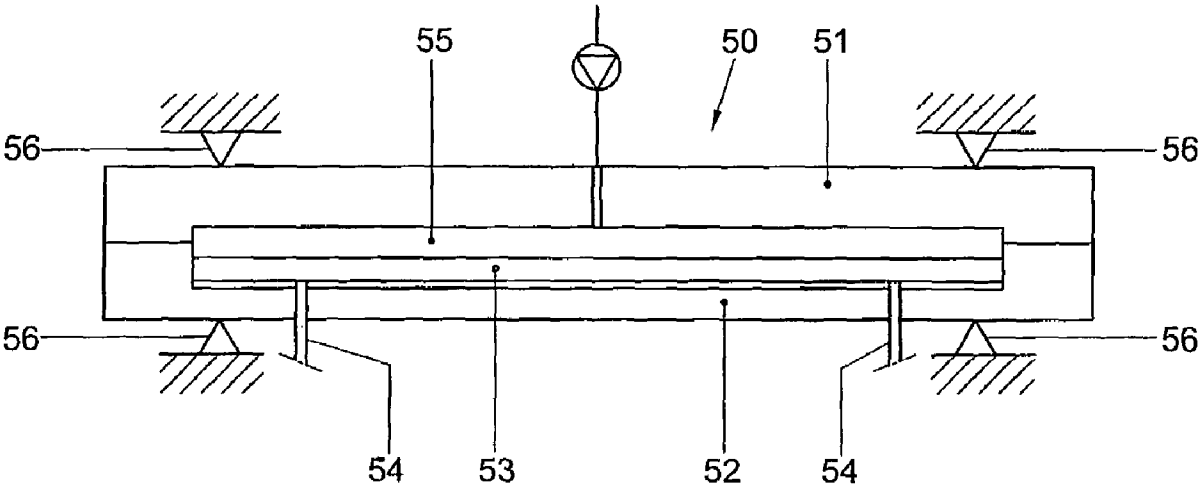
FIG. 8 diagrammatically shows, in cross-sectional side view, a mold for manufacturing a cover according to FIGS. 1 and 2, in a first phase of manufacture.
Figure 9:
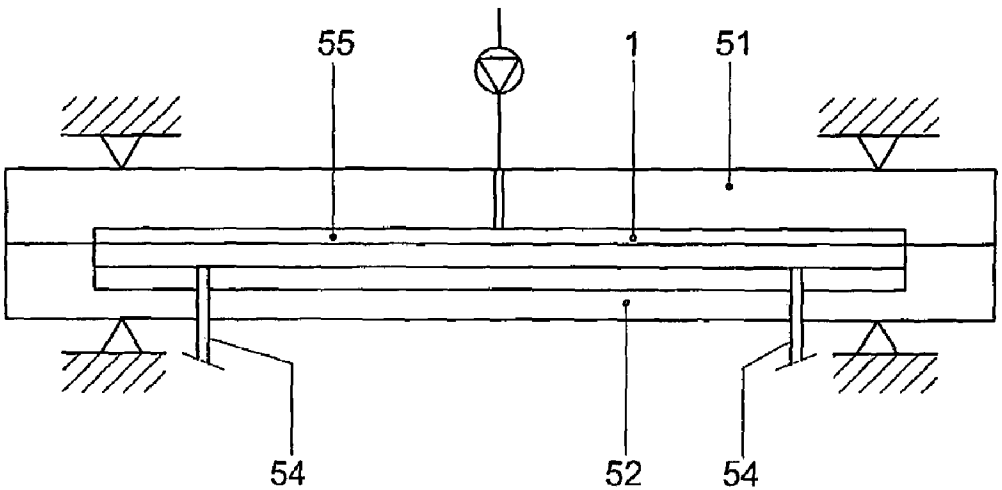
FIG. 9 shows the mold according to FIG. 8 during a second phase of manufacture of the cover.

FIG. 1 shows, in open condition, seen from the inside, a cover 1 for a file 100 according to the invention, which cover is provided with a front cover 2, a back cover 3 and a spine 4, hingedly interconnected via hinges 5, 6. The cover 1 is preferably manufactured in one piece by injection molding, for instance as specified below, in a mold as shown in FIGS. 8 and 9. The cover may be simply injection-molded in the relatively flat position shown in FIGS. 1 and 2, the hinges 5, 6 being of the living hinge type. Suitable plastics will be directly clear to those skilled in the art.

To stiffen at least the front cover 2 and the back cover 3, stiffening ribs 7 and a slightly thickened edge 8 are provided, the edge being rounded on the outside 9 for embellishment and to simplify the manufacture. Moreover, such a rounding is advantageous during use and damage is thereby prevented in a simpler manner. In the spine 4 is shown an opening 10, as is usual in files, through which, for instance, a finger can be inserted to pull the file out of a cabinet. The cover 1, in particular the spine 4, can be simply provided on the outside with parts that can be written on, for instance by in-mold labeling. Also, on the outside 11 and/or the inside of the cover 1, a finishing layer, for instance texture, may be provided by means of in-mold labeling technique, printing technique or the like. Texture may also be obtained by appropriate adjustment of the respective wall parts of the mold.

Figure 3:
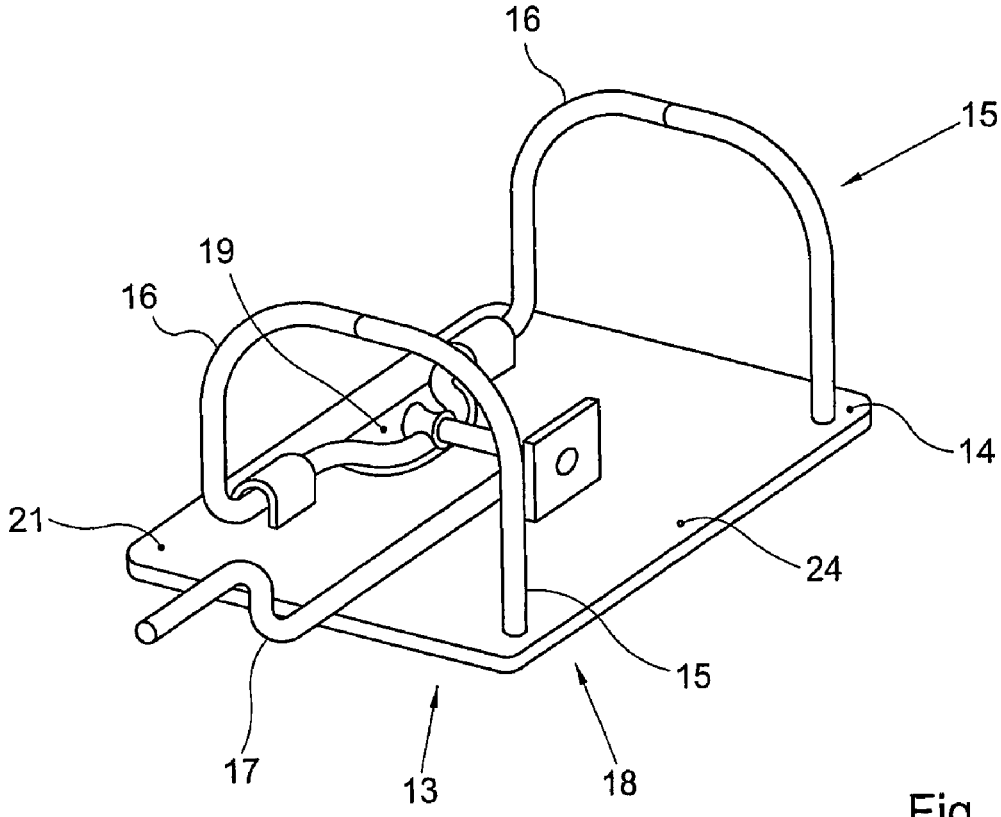
FIG. 3 diagrammatically shows, in perspective view, an arch for a file according to the invention.

On the back cover 3 near the spine 4 are provided first coupling means 12 in which an arch 13, for instance as shown in FIG. 3, can be fixed after forming the cover 1, more in particular prior to use of the file 100. Such arches 13 are sufficiently known from practice for files. The arch 13 will therefore not be described in more detail as far as not necessary for a proper understanding of the invention.

Figure 5:
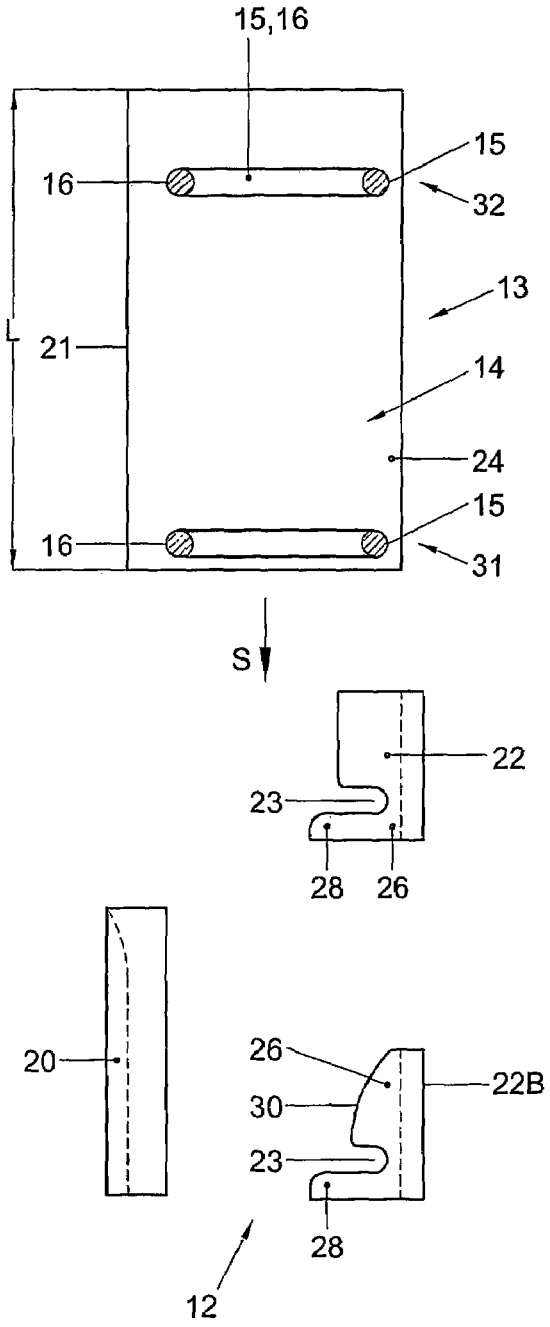
FIGS. 5-7 show, in three steps, the positioning of an arch according to FIG. 3 in a cover according to FIGS. 1 and 2.
Figure 6:
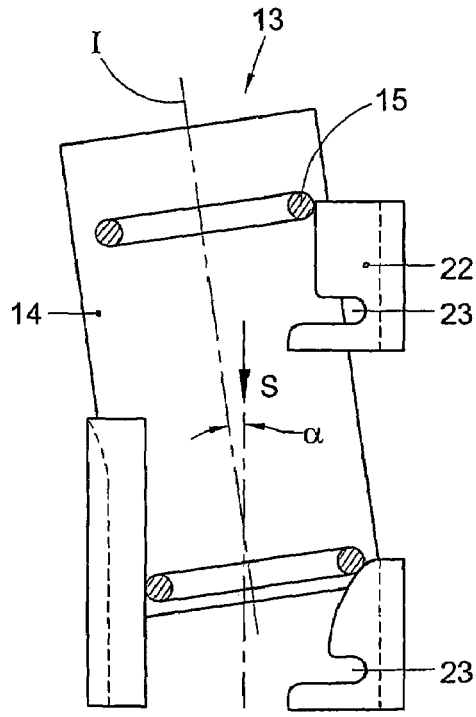
Figure 7:
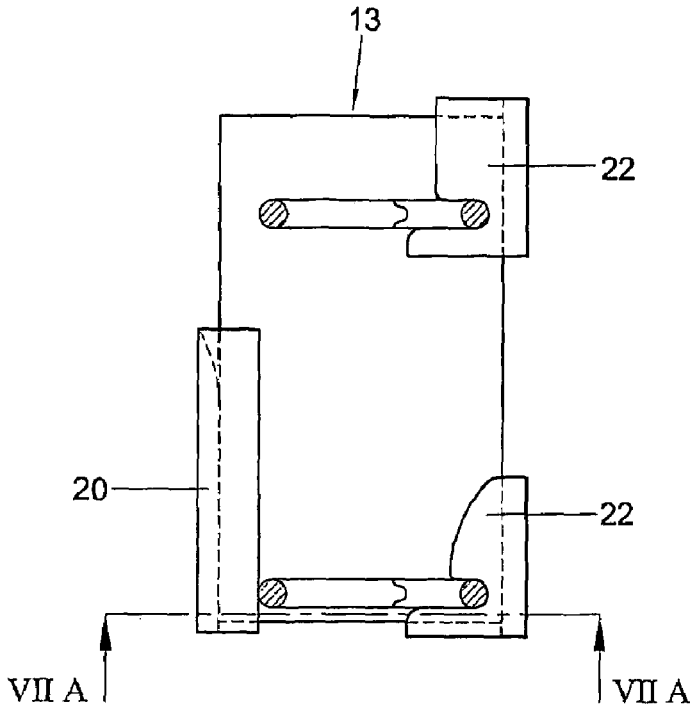

The arch 13 comprises a baseplate 14, for instance with a substantially rectangular, rounded outer form. Fastened to the baseplate are two bent front legs 15 and interconnected back legs 16, which are likewise bent and can be moved against the front legs 15 or pivoted away therefrom by means of a lever 17, in which latter position paper and the like can be slid over the front legs 15 with appropriate perforations. The front legs 15 are connected with the baseplate 14 in a position stable manner. The baseplate 14 and the front legs 15 together substantially form second coupling means 18, which can cooperate with the first coupling means 12, in a manner to be specified, for fixing the arch 13 in the cover 1. The first coupling means comprise guide means 20, which can cooperate with at least one longitudinal edge 21 of the baseplate 14 as second guide means, two clamping means 22 being provided in the first coupling means for fixing the arch 13 in the guide moans 20. To this end, the clamping means 22 are provided with recesses 23, in which the front legs 15 can be fixed. In FIGS. 5-7 is specified in three steps how the arch is fixed in the first coupling means 12. For clarity's sake, the arch 13 is shown in FIGS. 5-7 only diagrammatically, while omitting the pivoting arm 17, spring means 19 and the like. The legs 15, 16 are shown on the baseplate 14 in cross-section, the further legs 15, 16 being diagrammatically shown therebetween (in projection).

Figure 7A:
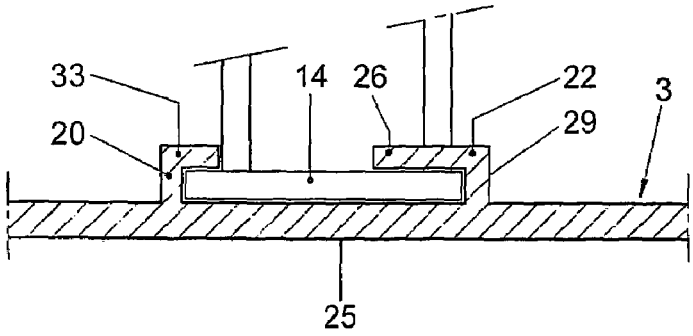

The first coupling means 12 comprise a first guide means 20 in the form of a substantially straight guide with an approximately L-shaped cross-section. As apparent from FIG. 4, this guide element 20 is placed such that the longitudinal edge 21 of the baseplate 14 can be slid thereunder over, for instance, approximately half the length L of the baseplate 14, such that the longitudinal edge 21 is held thereunder. Placed at a distance from the guide element 20 are two clamping elements 22, likewise having a substantially L-shaped cross-section, such that the second longitudinal edge 24 situated opposite the longitudinal edge 21 can be slid thereunder. This situation is shown in FIG. 7*a* in cross-sectional view. It is clear that then the baseplate 14 is enclosed between, on the one hand, the surface 25 of the back cover 3 and, on the other hand, the guide element 20 and the clamping elements 22. The clamping elements 22 each comprise a flange 26, which extend approximately parallel to the surface 25 of the back cover 3, in which flanges 26 the recesses 23 are provided. The receses 23 are open toward the side proximal to the guide element 20. In leading position seen in the slide-in direction S, a tongue 28 is provided behind each recess 23, which tongue projects from the wall 29 farther than the opposite flange part 30 and serves as catch means.

The arch 13 can be placed as follows.

The arch is placed with the baseplate 14 on the back cover 3, slightly beside the, in FIGS. 5, 6 and 7 upper, clamping element 22, the baseplate 14 being slightly rotated, such that the longitudinal axis I thereof encloses an angle $\alpha$ with the slide-in direction S. Subsequently, the first arch 31, shown at the bottom of FIG. 5, is slid along the upper clamping element 22A to between the guide element 20 and the flange part 30 of the lower clamping element 22B. This position is shown in FIG. 6. Subsequently, the arch 13 is pushed further in the slide-in direction S, thereby slightly elastically deforming at least the clamping elements 22, until the lower arch 31 strikes against the tongue 28 of the lower clamping element 22B, while the respective front leg 15 of the arch 31 is received in the respective recess 23. Then the front leg 15 of the other arch 32 will be automatically received in the opening 23 of the, in FIG. 6 upper, clamping element 22A, such that the longitudinal axis I is rotated back, until it extends parallel to the slide-in direction S. In this condition, the arch 13 is secured in the first coupling means 12 against any movement, as shown in FIG. 7. The guide element 20 and/or the clamping elements 22, which are slightly elastically deformed when slid in, will assume their original form again to even better fix the arch 13. Optionally, a further recess (not shown) may be provided in the horizontal flange 33 of the guide element 20, in which recess the back leg 16 of the lower arch 31 can be received, so that the arch 13 is even better secured against movement, in particular rotation.

Figure 7B:
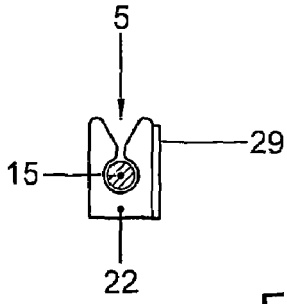

It will be clear that all kinds of other means may also be provided for fixing the arch 13 to the cover 1, in particular against the back cover 3, for instance click means gripping around the legs, as diagrammatically shown in FIG. 7B, where the front leg 15 and/or the back leg 16 can be simply slid in the slide-in direction S, but cannot be pulled loose therefrom anymore. In a comparable manner, such a clamping element 22 may be connected with the surface 25 via a raised wall part 29. Also, for instance on the cover 3, there may be provided pins, which extend approximately at right angles to the surface 25 or enclose an obtuse angle therewith, which pins can elastically deform when the baseplate 14 is slid on and can spring back into openings in the baseplate, while, again, for instance longitudinal edges 21, 24 of the baseplate 14 are guided by guide elements, such as guide element 20. These and many variations are deemed to fall within the scope of the invention as defined by the claims.

A file 100 according to the invention can be used as follows.

Figure 4:
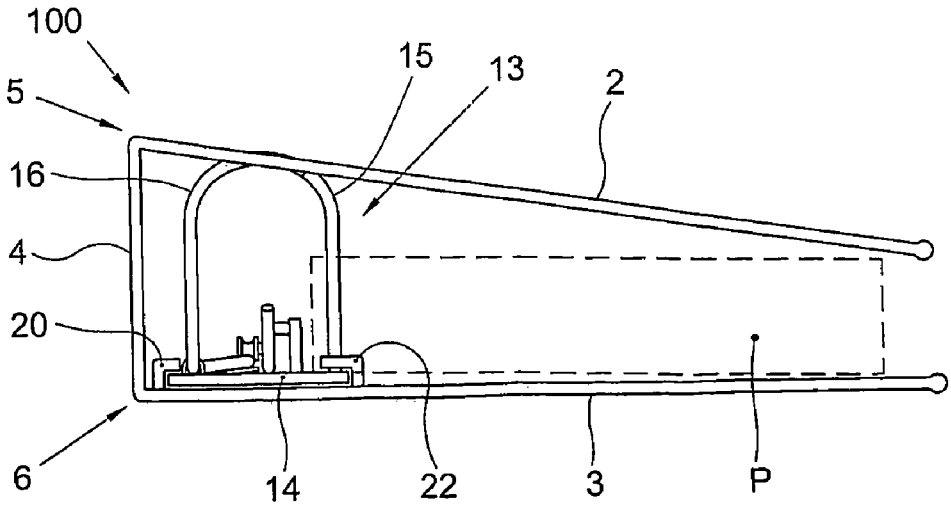
FIG. 4 shows, in side view, a file according to the invention, in closed condition, composed of a cover according to FIGS. 1 and 2 and an arch according to FIG. 3.

A series of covers 1 is placed in flat condition in a container, for instance a box, in which the covers 1 can be simply packed in a compact manner. Here, unlike existing files, there is practically no loss of space within the container. An equal number of arches 13 is packed apart from the covers 1, at least separately therefrom. In this condition, the assemblies are transported to users. Prior to use, a cover 1 is taken from the container, an arch 13 is fixed thereon, preferably in the manner as described above, is after which the file is ready for use. Paper and the like, as shown in FIG. 4 in broken lines, can be fixed on the arch 13, in a manner known per se. Subsequently, the file 100 can be closed by folding the front cover 2 over the paper P. Provided in the front cover 2 are two openings 40 with clamping lips 41, as in known files, with which the front cover 2 can be fixed on the arch 13, in particular the legs 15, 16.

In FIG. 8 is shown a mold 50, comprising a first part 51 and a second part 52, in which the second part 52 is provided a movable wall part 53, operable from outside the mold 50 by arms 54, diagrammatically shown in FIGS. 8 and 9. Provided inside the mold 50 is a mold cavity 55, a part of which is defined by the movable wall part 53, in which mold cavity 55 the cover 1 can bc formed. At the start of injection molding, plastic is brought into the mold cavity 55 with withdrawn movable wall part 53, that is to say the space of the mold cavity 55 is relatively large. Subsequently, when the mold cavity 55 is nearly completely filled with plastic, for instance more than 80%, the movable wall part 53 is moved in the direction of the first part 51, so that the volume of the mold cavity decreases to the desired final volume, while or after which after pressure is applied in the conventional manner to completely fill the mold cavity and to obtain a substantially stress-free product. In the position shown in FIG. 9, a cover 1 is formed in a completely dimensionally stable manner. It is clear that during injection molding, the mold 50 is kept closed, as diagrammatically shown by closure elements 56. With such a method, a cover that is relatively dimensionally stable can be manufactured in a very simple manner, using relatively light tools, while, moreover, a high degree of freedom in the choice of plastic is obtained. This is because, as a result of the movable wall part, broad flow paths are obtained during the largest part of the filling of the mold, so that both high-melt and very low-melt plastics can be used.

Figure 10:
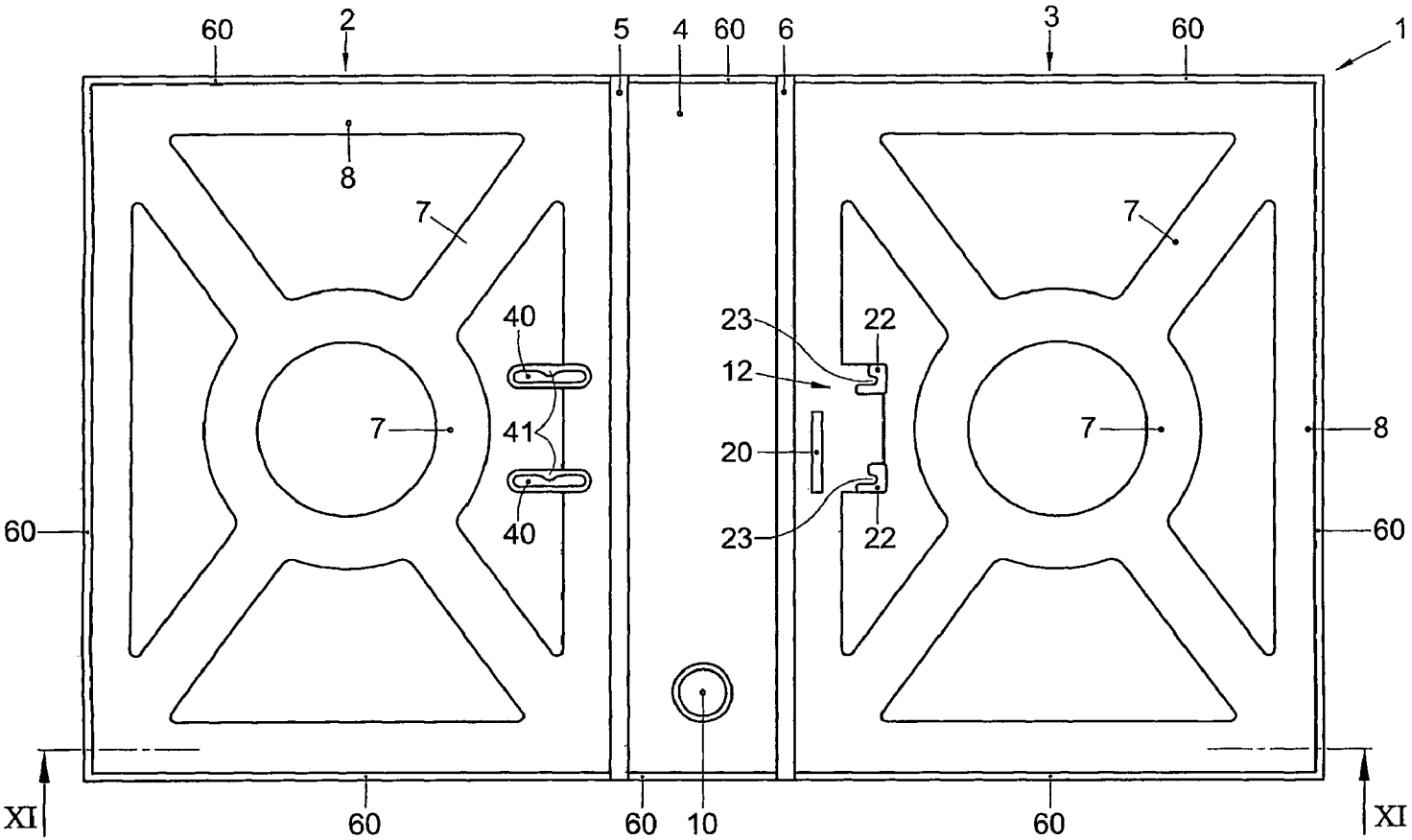
FIG. 10 shows a cover of a file according to the invention, similar to the cover of FIG. 1, provided with a raised longitudinal edge.
Figure 11:
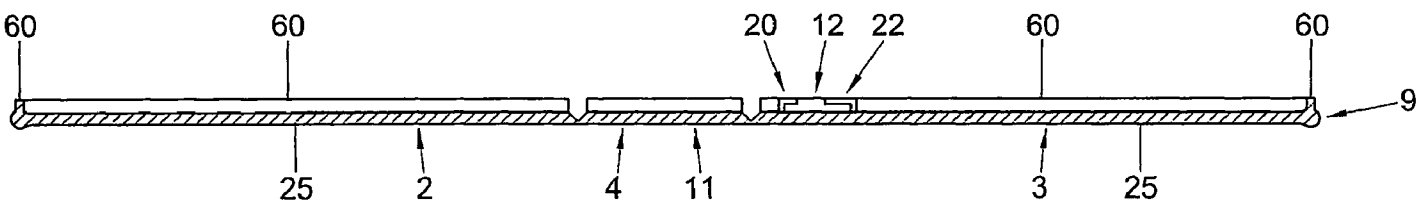
FIG. 11 shows, in cross-sectional side view along the line XI-XI, the file according to FIG. 10.

In FIGS. 10 and 11 is shown, in open condition, a file 1 according to the invention, similar to the file as shown in FIG. 1. Similar or corresponding parts again have similar or corresponding reference numerals. Thus, for the explanation of the FIGS. 10-19, as far as they are not further explained below, reference is made to the preceding figures.

In this embodiment, along the longitudinal edges of the front cover 2, back cover 3 and the spine 4, the file 1 is provided with a low, raised longitudinal edge 60, which is formed integrally with the rest of the file, at least the cover. In the embodiment shown, the longitudinal edge 60 extends along all free sides of the covers 2, 3 and the spine 4. However, this edge can also be formed by interrupted parts.

Figure 12:
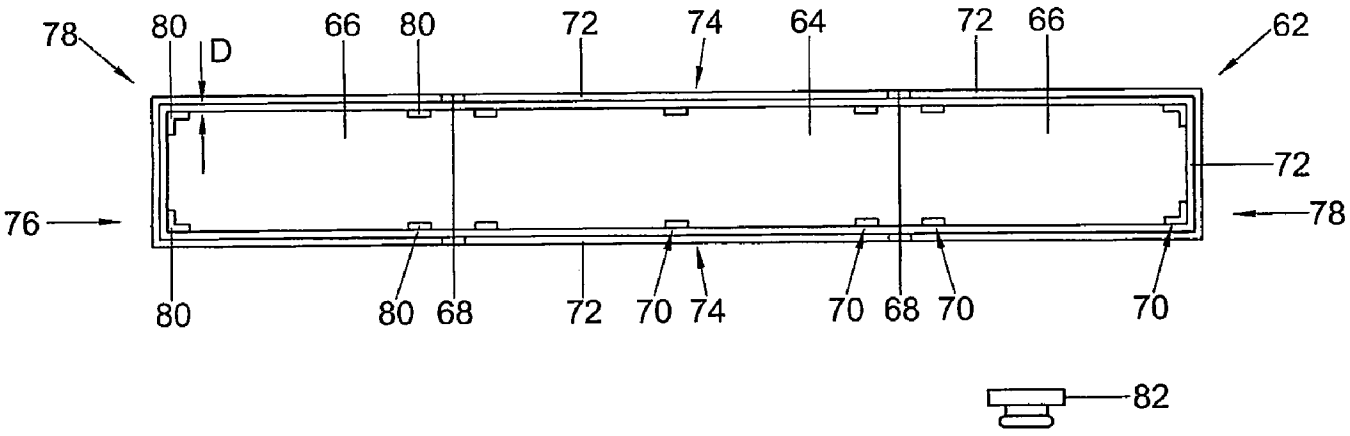
FIG. 12 shows, in open condition, a closure element according to the invention, with sealing cap.
Figure 13:
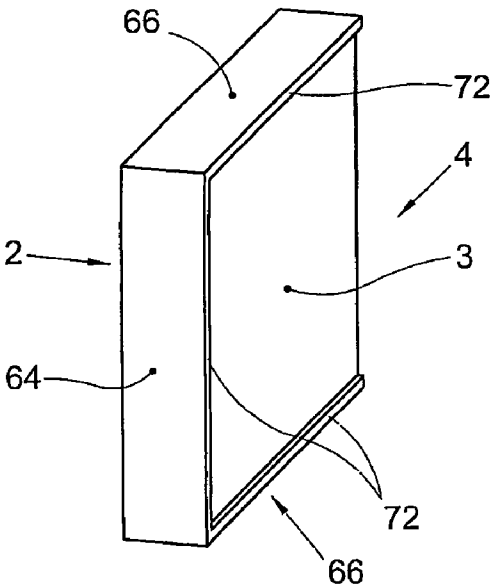
FIG. 13 shows, in perspective view, a file according to the invention provided with a closure element according to FIG. 12.
Figure 14:
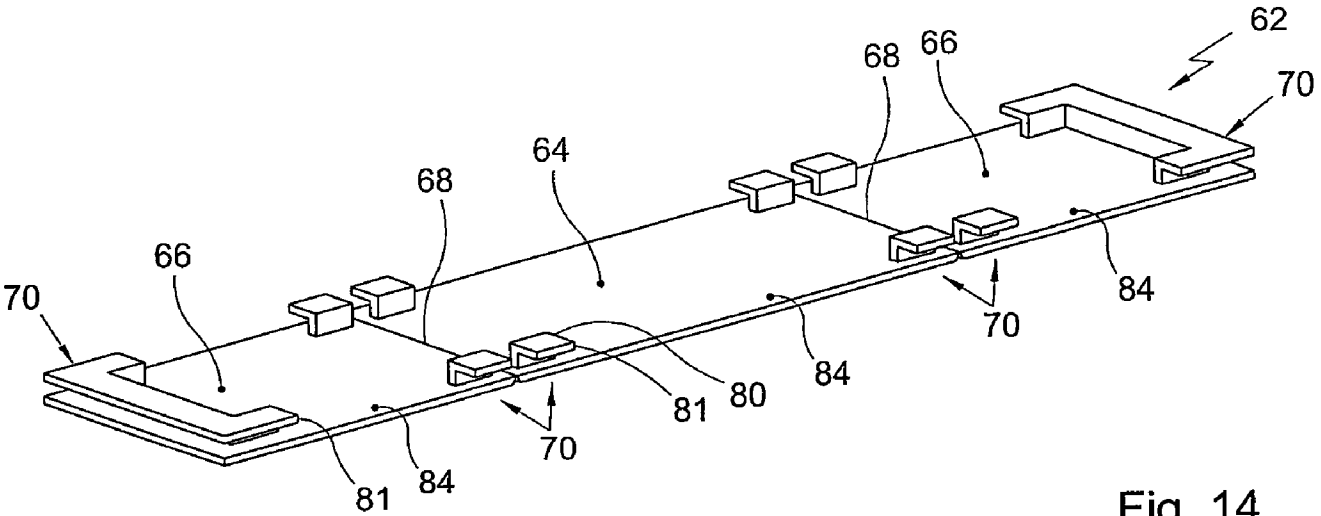
FIG. 14 shows, in open condition, a closure element according to the invention, in an alternative embodiment.
Figure 15:
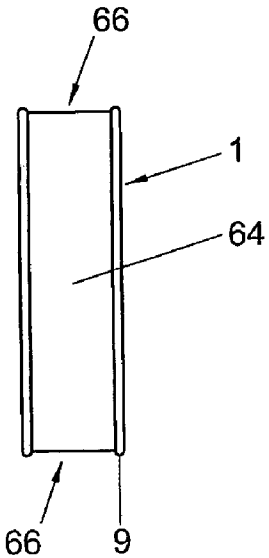
FIG. 15 shows the closure element according to FIG. 14 placed on a file.

FIG. 12 shows, in flat condition, a closure element 62 for use with a file, for instance according to FIG. 1 or a file known per se manufactured from cardboard, plastic or combinations thereof, with relatively flat, at least straight free longitudinal edges of the covers 2, 3 and the spine 4. In FIG. 13, the closure element 62 is shown, placed on such a file 1, in a manner further to be specified. In FIG. 14, a closure element 62 is shown in an alternative embodiment, suitable for application in, for instance, a file according to FIGS. 10 and 11. FIG. 15 shows the closure element 62 according to FIG. 14 placed on such a file 1.

The closure elements 62 as shown in FIGS. 12 and 14 both comprise three parts, a first part 64 that has approximately the same dimensions as the spine 4 of the file 1, and two second parts 66, each connected to the first part 64 via a hinge 68. The closure elements 62 are preferably manufactured in one piece with integrated hinges 68 by means of injection molding. The second parts 66 have such dimensions that these can be placed fittingly on the upper and lower longitudinal edges respectively of front and back cover 2, 3 and the spine 4 by means of clamping means 70 in order to obtain a file closed in a substantially dustproof manner that can be simply put away in a filing department or the like.

In the embodiment shown in FIG. 12, the clamping means 70 are formed by, on the one side, a relatively low, raised second edge 72 extending along the free longitudinal edges of the first part 64 and the second parts 66, which extends along both the long sides 74 and the ends 76. They are only interrupted near the hinges 68 so that the second parts can be pivoted over approximately 90° relative to the first part 64, in FIG. 12 up from the plane of the drawing. Within the longitudinal edge 72, near the corners 78 and at least near the hinges 68, at a distance D, which approximately corresponds to the thickness of the longitudinal edge 9 of the file 1, clamping studs 80 are placed.

A closure element 62 as shown in FIG. 12 can be simply fixed to a file 1 according to, for instance, FIG. 1 or as known from practice, by pushing the free longitudinal edges of the front and back cover 2, 3 of a file, with the front and back cover 2, 3 substantially parallel to each other, by the free longitudinal edges thereof, between the longitudinal edge 72 and the clamping studs 80, wherein the longitudinal edges are clamped by clamping means 70. In this manner, the closure element can be simply fixed on the file 1. Furthermore, in FIG. 12 is shown a cap 82, with such dimensions that said cap can simply be inserted in the opening 10 in the spine 4 of the file 1 from the inside or outside, thereby sealing this opening 10. In this manner, a dustproof file is obtained that can be simply filed. On the cap 82, which can be used in any of the exemplary embodiments shown, a code can be indicated by means of color, lettering or the like, by which the contents of the file can be identifiable. In addition, surfaces can optionally be provided on the closure element for applying, for instance, identification text, stickers or the like.

In FIG. 14, a similar closure element 62 is shown, wherein, however, the clamping means 70 are embodied in such a manner that the raised edges 60 of the file 1 according to FIGS. 10 and 11 can be clamped therein by sliding them in the clamping means 70 from a side. For this purpose, the clamping means 70 comprise studs 80 with flanges 81, which extend approximately parallel to the closure surfaces 84 of the first part 64 and the second parts 66, at a distance that is approximately the same as or is preferably slightly smaller than the thickness of the raised longitudinal edges 60. This provides a good clamping. In FIG. 15 is shown how such a closure element 62 can be placed on a file 1 according to FIGS. 10 and 11. Again, also in this manner a dustproof file is obtained.

Figure 16:
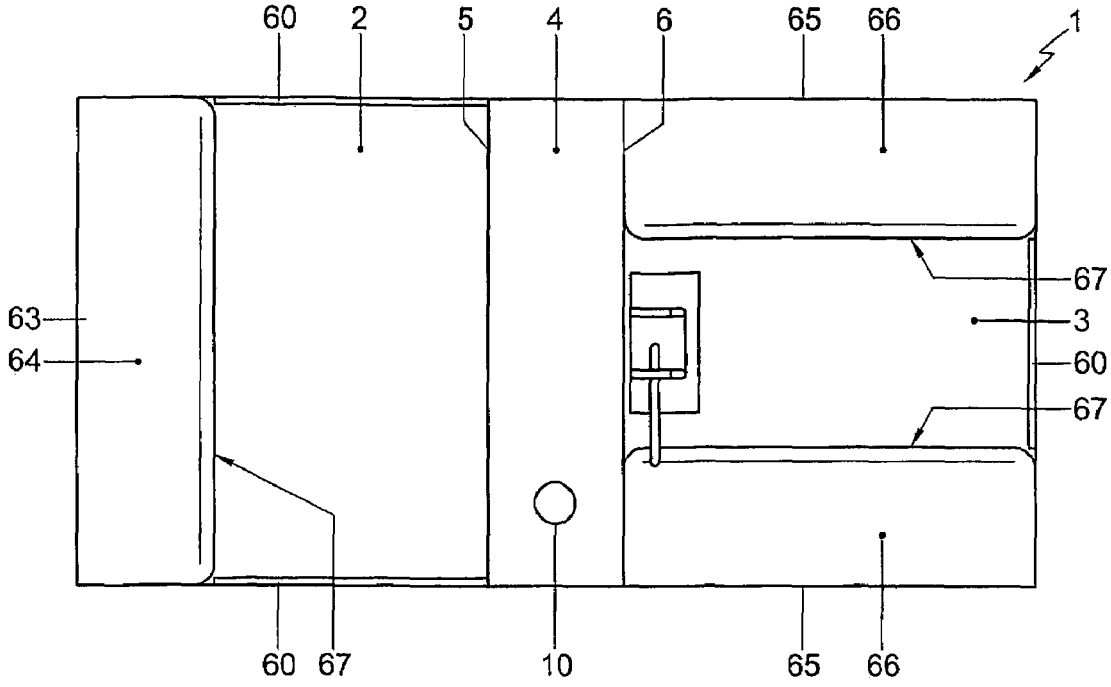
FIG. 16 shows the file with integrated closure element, at least closure means.
Figure 17:
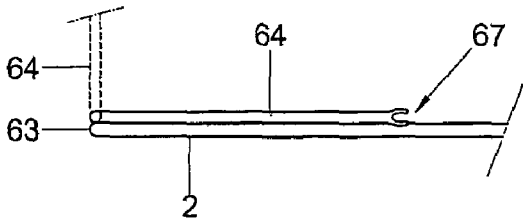
FIG. 17 shows, slightly enlarged, an edge of a cover with a part of a closure element of a file according to FIG. 16.

In FIG. 16, an alternative embodiment of a file 1 according to the invention is shown, again provided with a spine 4 with finger opening 10, as well as a front cover 2 and a back cover 3, hingedly connected with the spine 4 by a first and second hinge 5, 6. In this embodiment, a closure element 62 is provided, at least closure means are provided with which a closure element 62 can be formed, which means will be explained in more detail below, and which are preferably formed in one piece with the file 1 by means of injection molding.

In this embodiment according to FIG. 16, to the front cover 2 near the longitudinal edge remote from the spine 4, a first part 64 of the closure element 62 is fixed, hingedly connected with the front cover 2 via a co-injection-molded hinge 63. On the back cover 3, both near the upper edge and near the lower edge, a second part 66 of a closure element 62 is provided, again preferably co-formed in one piece with the file 1 and connected with the back cover 3 via hinges 65. In this, the hinge means 63, 65 are embodied such that the first part 64 and the second parts 66 respectively can be flatly folded against the front cover 2 and the back cover 3 respectively. Opposite the hinge 63 and the hinge 65 respectively, the first part 64 and the second parts 66 are provided with a clamping slot 67, as diagrammatically shown in more detail in Fir, 17 with reference to the first part 64 on the front cover 2. A similar clamping edge 67 is provided on the second parts 66 on the side remote from the hinge means 66. As diagrammatically shown in broken lines in FIG. 17, the first part 64, as well as the two second parts 66, can be pivoted over an angle of approximately 90° into a position at right angles to the front cover 2 and back cover 3 respectively. In this, the free longitudinal edges of the front cover 2 and the back cover 3 respectively are provided with relatively low, raised longitudinal wall parts 60 that can be clampingly received in the clamping edge 67 of the two second parts 66 and the first part 64 respectively.

During normal use, the first part 64 and the two second parts 66 are brought into the position shown in FIG. 16, after which paper can be simply placed into or taken away from the clamping arch 13. In this condition, the file can be used in a normal manner. Optionally, the longitudinal walls 60 can be provided with such at profiling that the first part 64 and the second part 66 respectively are kept in this flat condition. Also, these can be retained by, for instance, relatively weak adhesives or the like. When the file 1 is to be filed or is to be put away in a substantially dustproof and lightproof manner for other reasons, the first part 64 and the two second parts 66 are folded into said position, at right angles to the front cover 2 and back cover 2 respectively, after which the file is closed, such that the longitudinal walls 60 are received in the respective clamping slots 67, so that a closure element 62 is formed, at least the file is closed in a substantially lightproof and dustproof manner. In this condition, the file can be simply put away. Again, a cap 82 can be pushed into the opening 10.

Figure 18:
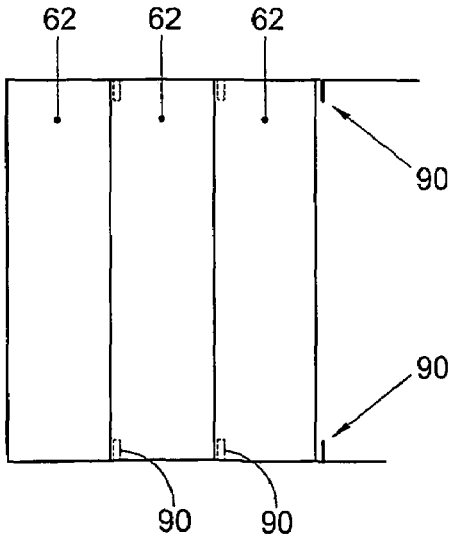
FIG. 18 shows three files intercoupled by closure elements.

In FIG. 18, a further alternative embodiment is shown, wherein the closure elements 62 are intercoupled by hooking means 90, in the shown embodiment diagrammatically shown by rail sections that extend along the second parts 66 and can engage in slots in the opposite longitudinal edges of a second closure element 62 of an adjacent file. In this manner, files can be coupled more readily in a filing position. It will be clear that other means can also be used to this purpose, for instance adhesives, Velcro or the like, applied on surfaces facing each other of the closure elements 62 and/or the covers 2, 3 of the files.

Figure 19:
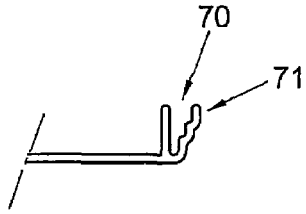
FIG. 19 shows, in cross-sectional side view, a part of an alternative embodiment of an edge of a cover of a file according to the invention with clamping means.

In FIG. 19, a part of a closure element 62 is diagrammatically shown with a clamping means 70, of which one edge, in particular the edge 71 facing outwards, is of stepped design, so that various thicknesses of longitudinal edges of covers of files can be clamped therein, thus yielding an even more universally applicable closure element. It will be clear that a comparable universally applicable closure element can be obtained by a more elastic, better deformable design of the clamping elements.

Figure 20:
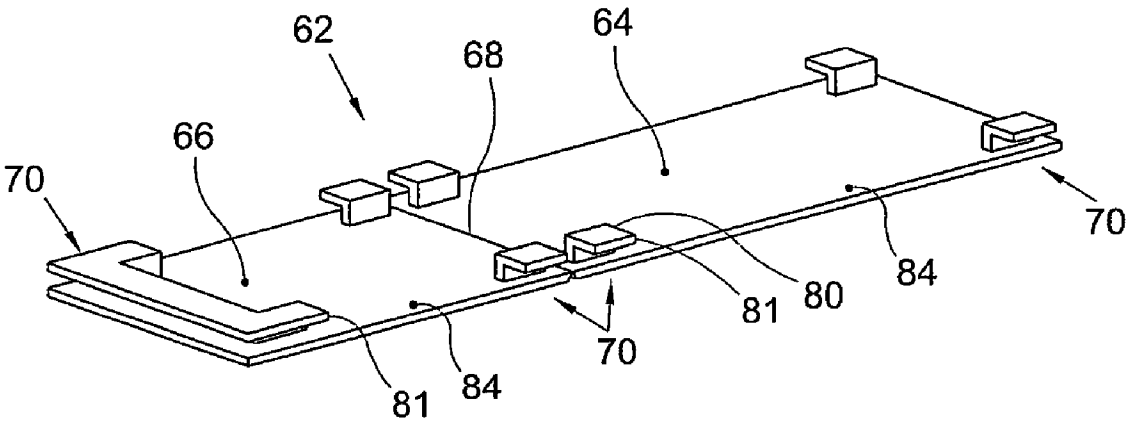
FIGS. 20-24 show alternative embodiments of an edge and file according to the invention.
Figure 21:
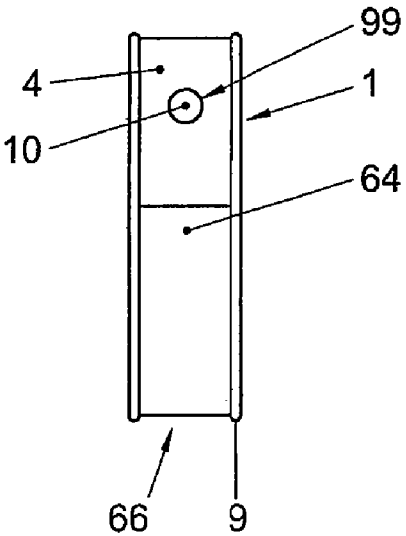

In FIGS. 20 and 21, an embodiment of a closure element 62 is shown. This substantially corresponds to the embodiment according to FIG. 14, wherein, however, the closure element 62 shown in FIG. 14 is only half thereof. This closure element comprises a front surface 64 and, pivotally connected thereto, a part 66 with the clamping means mentioned and shown in FIG. 14. As is clearly indicated in FIG. 21, this closure element can be clamped onto the lower longitudinal edges of the covers and against the lower parts of the longitudinal edges of the covers, so that a file in the shape of a file container is obtained which is closed on the bottom side and the lower part of the front side and is open on the upper side and the upper part of the front side, thereby forming an insert opening 99. Through this insert opening 99, papers or the like can be inserted and taken out. Optionally, a second closure element can be provided on the upper side for filing away the file. As is clearly indicated in FIG. 21, the arch 13 can be left out during use as a file container.

It will be clear that the same or similar closure elements can also be, used in the other shown embodiments. This means that a file according to the invention can be closed off by two substantially identical closure elements. Such closure elements can be manufactured in a simpler manner and, in addition, are suitable for several applications.

Figure 22:
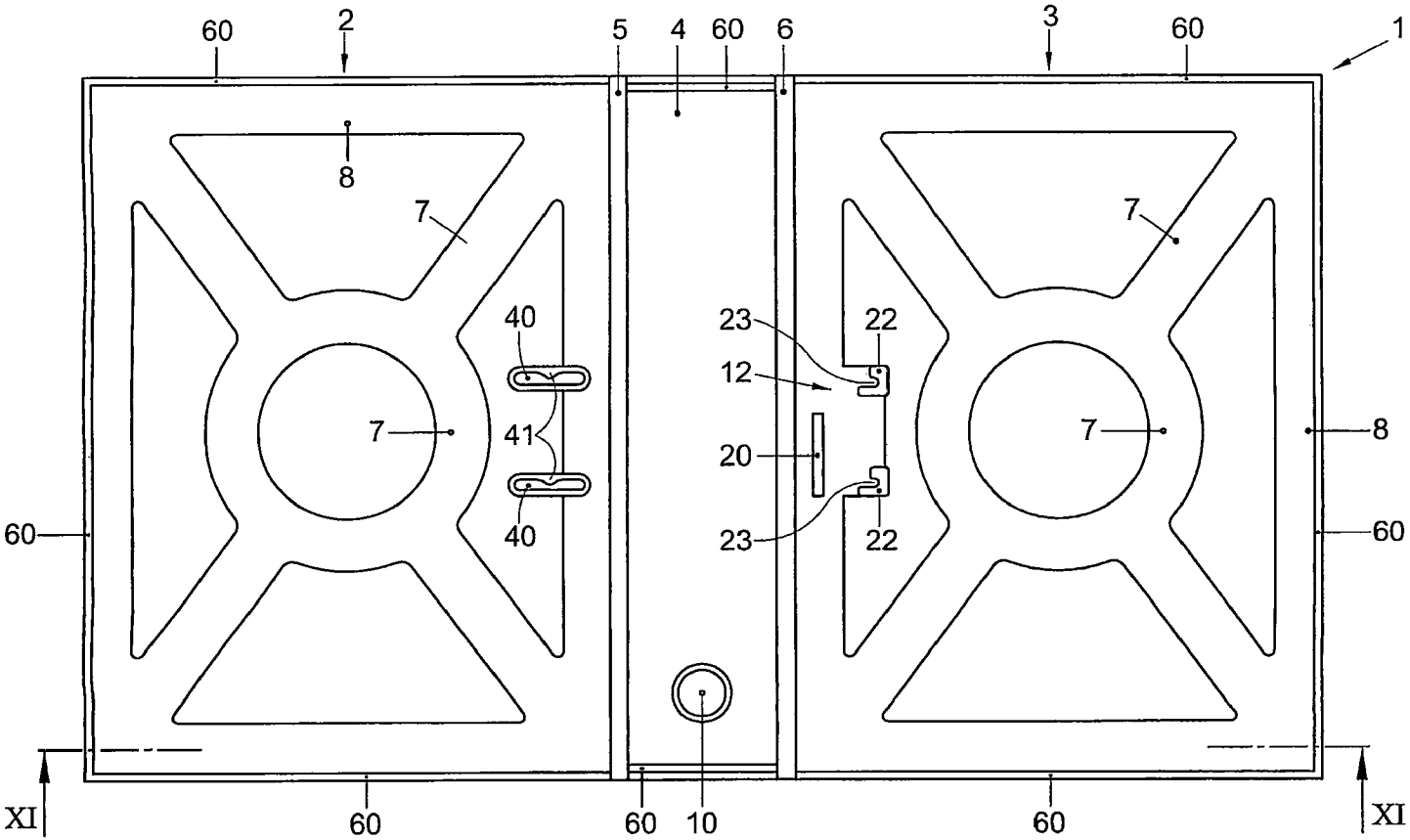
Figure 23:
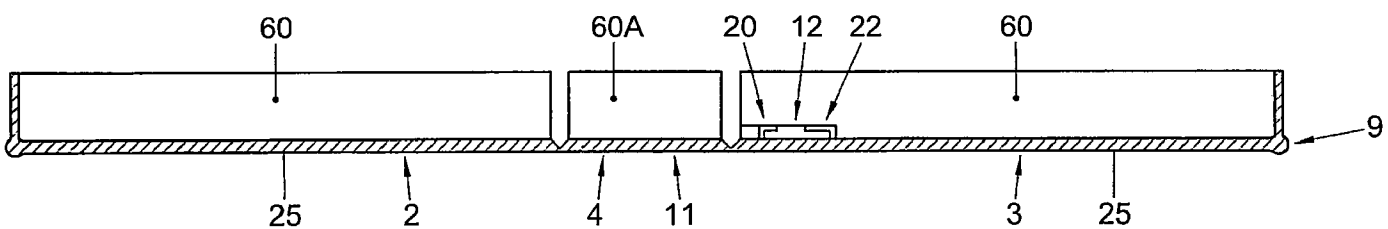

In FIGS. 22 and 23, a further alternative embodiment is shown, largely comparable with the embodiment as shown in FIGS. 10 and 11. In this embodiment, however, the edges 60 are raised to a height such that these together have a height approximately equal to the width of the spine 4 between the hinges 5, 6. On the spine, a wall 60A is provided as well, which is slightly offset inwards. When closing the file, the walls 60 will fall against each other and on the outside against wall 60A, thus yielding a closed file that is particularly suitable as, for instance, a travel file and/or archive file, without loose closure elements being necessary.

Figure 24:
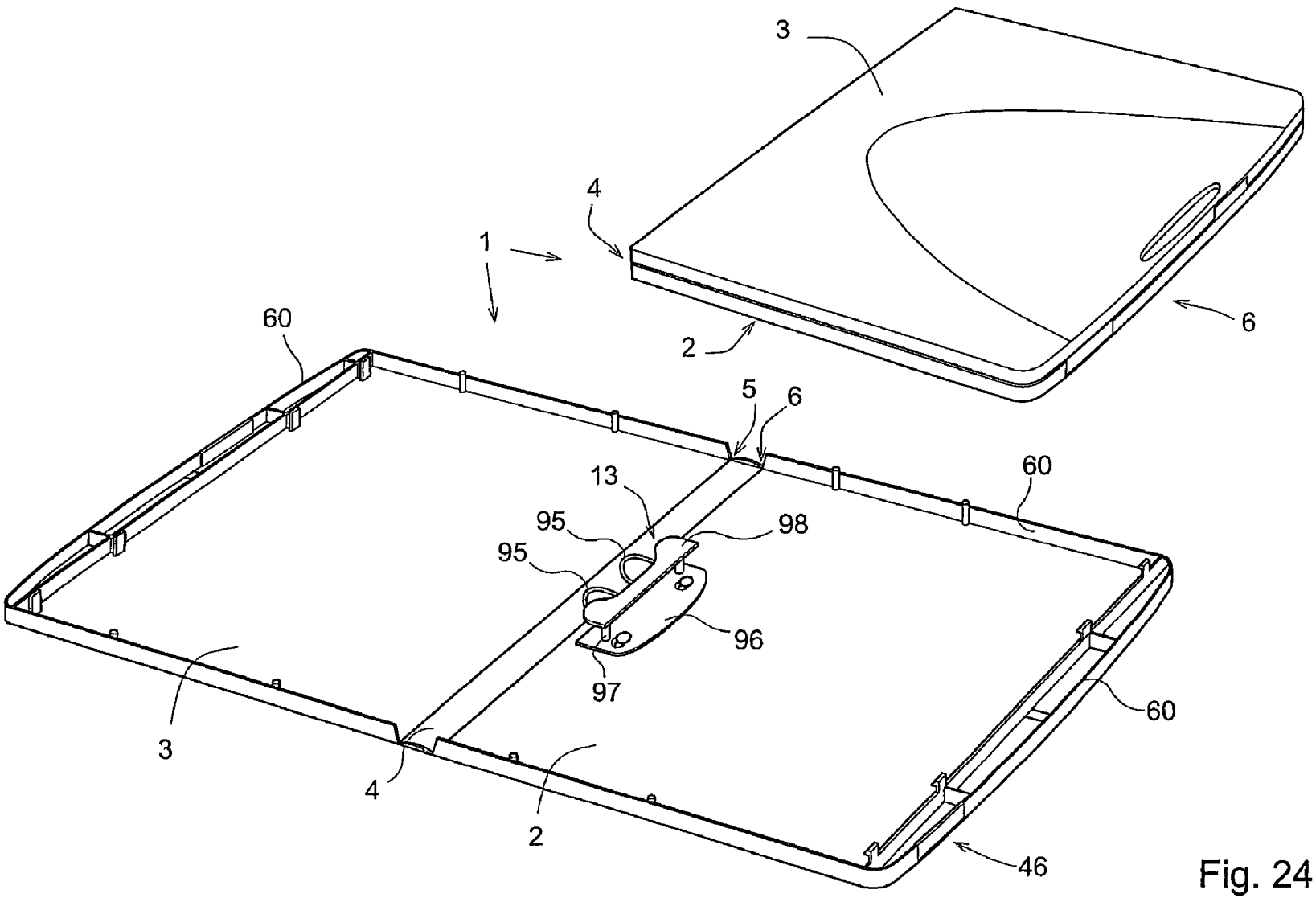

In FIG. 24, an alternative embodiment is shown of a file similar to the file shown in FIGS. 22 and 23, wherein an arch 13 is provided in an alternative embodiment. In this, a locking plate 98 on two pins 97 is provided that is axed thereon or therein by clamping. The baseplate 96 on which the pins 97 are fastened is fixed on a cover. The locking plate is connected with the baseplate 96 via flexible strips 95. This travel and/or archive file can be manufactured in a simple manner at low cost.

The invention is not in any way limited to the exemplary embodiments described in the specification and shown in the drawings.

Many variations thereof are possible within the scope of the invention defined by the claims.

Thus, the arches may be fixed on the cover in various manners. For instance, screw means, clamping means and the like may also be used, in particular for the use of a described method in which covers and arches are delivered separately and are only composed preferably directly before use. With such a method, special advantages are obtained, in particular during storage and transport. In such a method, for that matter, other types of materials may be used as well, for instance covers partly or completely formed from cardboard or plastic plate and the like. Covers for use in a file according to the invention may also be injection molded in another manner, in other, more conventional injection molding devices. As described, different arches may be used as well, for instance two-, three- or multi-ring binders that can be fixed on a cover in the same or in a comparable manner. Optionally, arches may also be placed from an outside of the cover, by pushing the legs through slit-shaped openings and fixing them on the inside.

Of course, a closure element 62 according to the invention can also be formed in a different manner and from different materials, for instance from loose parts, which can be coupled detachably or otherwise pivotally with the covers 2, 3 and/or the spine 4, while a closure element can be manufactured from, for instance, cardboard. The clamping means, at least the means for fixing a closure element on a file can also be embodied differently, for instance by constructing one or more of the covers 2, 3 and/or the spine 4 with slot-shaped recesses in which a further substantially flat closure element, such as for instance shown in FIG. 12 or 14, can be fixed, but without clamping means, while in addition, a closure element can be provided with lips that can be inserted in fitting recesses, slots or the like in the file or can grip behind the longitudinal edges 60 like a snap finger. Also, the parts of the closure element can be hingedly fixed on both the front cover and the back cover, such that both on the front cover and the back cover, for instance, half of the first part and both second parts respectively is provided, which can be intercoupled.

These and many comparable variations are deemed to fall within the scope of the invention as defined by the claims.

The invention claimed is:

1. A file comprising:

a cover provided with a front cover portion, a back cover portion and a spine connecting the front and back cover portions, wherein at least the front cover portion and the back cover portion are provided with first and second lateral edges extending outwardly from the spine and a longitudinal edge connecting the lateral edges opposite the spine; and a closure element removably coupled with the cover, the closure element having a first part, a second part and a hinge portion of reduced thickness pivotably connecting the first part and the second part, wherein the closure element can be initially provided in a generally planar condition, and wherein the first and second parts can be pivoted about the hinge portion for coupling with the cover, wherein the first part is coupled with the first lateral edge of each of the front and back cover portions and the second part is coupled with the longitudinal edge of each of the front and back cover portions, such that the space enclosed by the front cover, back cover and the spine is at least partly covered by the closure element and the file with the closure element has a partly open or substantially closed box shape.

2. A file according to claim 1, further comprising a binding element attached to the cover for detachably fixing sheets, between the front cover portion and the back cover portion.

3. A file according to claim 1, wherein the closure element further comprises a third part and a second hinge pivotably connecting the third part to the second part, wherein the third part can be pivoted about the hinge for coupling with the cover, such that the third part is coupled with the second lateral edge of each of the front cover portion and the back cover portion, while the two remaining parts can connect to the longitudinal edge and the first lateral edge.

4. A file according to claim 1, wherein the closure element is manufactured in one piece, by injection molding.

5. A file according to claim 1, wherein the closure element near two opposite edges is provided with clamping means for clamping the closure element on at least one of the first lateral edges and the longitudinal edges of the front cover portion and the back cover portion and/or the spine.

6. A file according to claim 5, wherein the clamping means are arranged for cooperation with various thicknesses of longitudinal edges of covers.

7. A file according to claim 1, wherein the front cover portion and/or the back cover portion is provided along at least one of the first or second lateral edges or the said longitudinal edges with a wall part raised in relation to the surface of the respective cover portion, and wherein the closure element comprises a clamping means for receiving the raised wall part therein.

8. A file according to claim 7, wherein the closure element clamping means comprises a flange extending parallel with at least one of the first and second parts and defining a receiving groove for receiving the raised wall part therein.

9. A file according to claim 1, wherein the closure element is provided with coupling means for coupling with a similar closure element, such that files arranged next to each other can be intercoupled by the closure elements.

10. A file according to claim 1, wherein in the spine at least one opening is provided through which a finger can be inserted for manipulating the file, wherein a sealing cap is provided that can be pushed into said at least one opening for closure thereof.

11. A file according to claim 1, further comprising a second two-part closure element that is fixable partly on top of and partly against the side of the file, such that a completely closed box-shaped file is obtained, the second closure element having a first part, a second part and a hinge pivotably connecting the first part and the second part, wherein the closure element can be initially provided in a flat condition, and wherein the first and second parts can be pivoted about the hinge for coupling with the cover, wherein the first part is coupled with the second lateral edge of each of the front and back cover portions and the second part is coupled with the longitudinal edge of each of the front and back cover portions.

12. A file according to claim 1, wherein the file with placed closure element forms a partly closed box-shaped file container.

* * * * *

UNITED STATES PATENT AND TRADEMARK OFFICE

CERTIFICATE OF CORRECTION

PATENT NO. : 7,478,964 B2
APPLICATION NO. : 10/507401
DATED : January 20, 2009
INVENTOR(S) : Hoogland It is certified that error appears in the above-identified patent and that said Letters Patent is hereby corrected as shown below:

| | |
|---|---|
| Column 3 line 57 | now reads “guide moans”<br>should read --guide means-- |
| Column 5 line 11 | now reads “above, is after which”<br>should read --above, after which-- |
| Column 5 line 25 | now reads “the cover 1 can bc formed”<br>should read --the cover 1 can be formed-- |
| Column 7 line 20 | now reads “the hinge means 66”<br>should read --the hinge means 65-- |
| Column 8 line 39 | now reads “that is axed thereon”<br>should read --that is fixed thereon-- |
| Column 10 line 7 | now reads “in one piece, by injection molding”<br>should read --in one piece by injection molding-- |

Signed and Sealed this

Thirtieth Day of June, 2009

John Doll

JOHN DOLL
*Acting Director of the United States Patent and Trademark Office*